US005145411A

United States Patent [19]

Pastal et al.

[11] Patent Number: 5,145,411

[45] Date of Patent: Sep. 8, 1992

[54] CONNECTOR INSERT RETENTION SYSTEM

[75] Inventors: Michael E. Pastal, Lebanon; Patrick F. Yeager, Middletown, both of Pa.

[73] Assignee: AMP Incorporated, Harrisburg, Pa.

[21] Appl. No.: 745,026

[22] Filed: Aug. 14, 1991

[51] Int. Cl.[5] ..... H01R 13/516

[52] U.S. Cl. ..... 439/598; 439/903

[58] Field of Search ..... 439/589, 598, 701, 903

[56] References Cited

U.S. PATENT DOCUMENTS

| | | | |
|---|---|---|---|
| 2,669,701 | 2/1954 | Brus | 439/598 |
| 3,885,849 | 5/1975 | Bailey et al. | 439/901 |
| 4,361,376 | 11/1982 | Gallusser et al. | 439/598 |
| 4,477,022 | 10/1984 | Shuey et al. | 339/59 M |
| 4,684,187 | 8/1987 | Rudy, Jr. et al. | 439/600 |
| 4,686,333 | 8/1987 | Hoffman et al. | 200/6 B |
| 4,710,135 | 12/1987 | Aoyama et al. | 439/598 |
| 4,871,320 | 10/1989 | Mouissie | 439/78 |

*Primary Examiner*—Neil Abrams
*Attorney, Agent, or Firm*—Anton P. Ness

[57] ABSTRACT

A dielectric insert of an electrical connector is retained within a metal shell by a plurality of latching ledges formed integrally with said insert member spaced about the periphery of the outer surface thereof and facing the trailing end during insertion into the shell member, to latchingly engage with corresponding stop surfaces defined along inside surfaces of the metal shell facing the direction opposite from the latching ledges. A lip about the periphery of the trailing end of the insert member engages the leading edge of the shell to define a second stop means, preventing insert movement in both axial directions. The insert is dimensioned for the latching projections defining the latching ledges to be compressed during insertion by bearing against the inside surfaces of the shell member until fully inserted into the shell cavity.

9 Claims, 2 Drawing Sheets

CONNECTOR INSERT RETENTION SYSTEM

FIELD OF THE INVENTION

The present invention relates to the field of electrical connectors and more particularly to retention of connector inserts in shells of the connector.

BACKGROUND OF THE INVENTION

Certain electrical connectors comprise dielectric housings in which electrical contacts or terminals are secured, and a shell member surrounds the housing for physical protection and also for shielding and grounding purposes. Conventional methods for retaining the housing (or insert) within the shell include adhesive material, locking rings or other hardware, or assembly of two shell halves about the insert. Any of these methods involves assembly steps and parts or materials all of which increases the cost of manufacturing.

It is desired to provide a system for assuredly retaining an insert within a shell without accessories or complicated procedures.

SUMMARY OF THE INVENTION

The retention system of the present invention includes formation of a plurality of latching projections about the periphery of the outer surface of a molded plastic insert member which define an array of latching ledges comprising stop surfaces in generally a common plane, and also a lip at a first or trailing end of the insert about most of the periphery at that end which comprises a series of stop surfaces facing the opposite direction. The shell member is formed to provide stop surfaces corresponding to the insert latching ledges. During assembly as the second or leading end of the insert is inserted into the shell member, gently tapered bearing surfaces of the latching projections extending from the second insert end bear against the inside surface of the shell and the insert is slightly compressed inwardly; when the ledges pass by the shell stop surfaces, the insert relaxes and the ledges latch behind the shell stop surfaces. The peripheral lip engages the edge of the shell member at the insertion face, and the lip and the latching ledges prevent movement of the insert in either direction relative to the shell member, providing retention. The stop surface defined by the lip is preferably tapered to engage a preferably tapered edge of the shell, while the latching ledges and corresponding shell stop surfaces are preferably rectilinear. Using plastic material having limited compressibility, the latching ledges need only be incremental in transverse dimension.

To facilitate a simple molding procedure for the plastic insert, core pins extend from one mold half to form the ledges at selected locations having limited width, which locations correspond with gaps in the otherwise continuous lip formed on the first end of the insert adjacent that mold half.

It is an objective of the present invention to provide two arrays of stop surfaces molded integrally on the connector insert facing opposite axial directions, to cooperate with corresponding arrays of stop surfaces defined along the inside of the shell member to secure the insert against all axial movement upon full insertion, providing insert retention without adhesive or accessories or involved procedures.

An embodiment of the retention system of the present invention will now be described by way of example with reference to the accompanying drawings.

DETAILED DESCRIPTION OF THE PREFERRED EMBODIMENT

Figure 1:
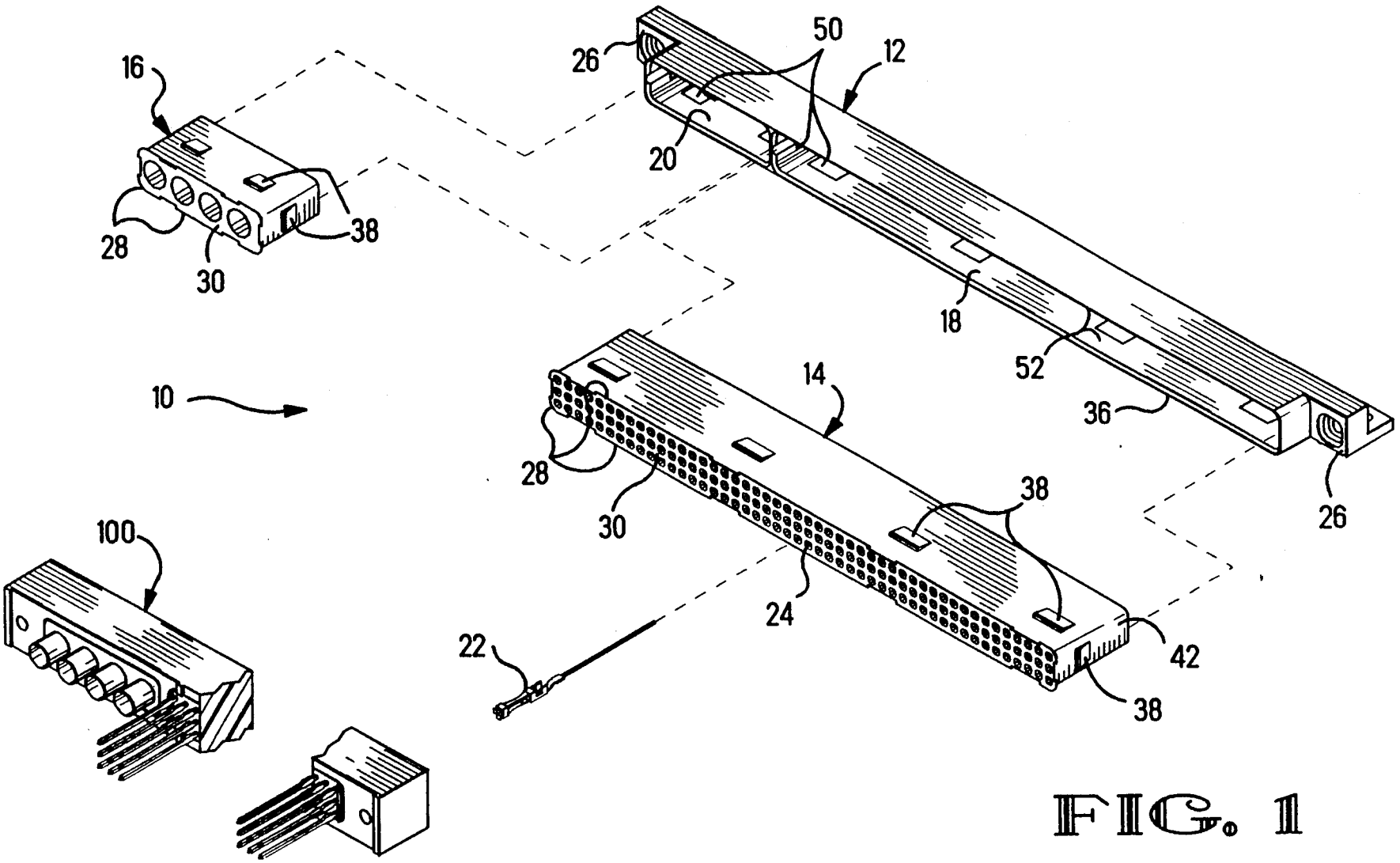
FIG. 1 is an isometric view showing the inserts of a hybrid connector exploded from the common shell member, matable with a second connector.

Connector 10 includes a single shell member 12 and two insert members 14, 16 insertable into respective cavities 18, 20 of shell member 12. Insert member 14 is shown to be adapted for conventional signal contacts 22 to be inserted into respective passageways 24, while insert member 16 is shown to be adapted for receipt of coaxial contact assemblies (not shown). Mating connector 100 is shown which may also include the insert retention system of the present invention. Flanges 26 at ends of shell member 12 are apertured for use with conventional accessories for keying and/or fastening of connectors 10, 100 together during and after mating respectively.

Figure 2:
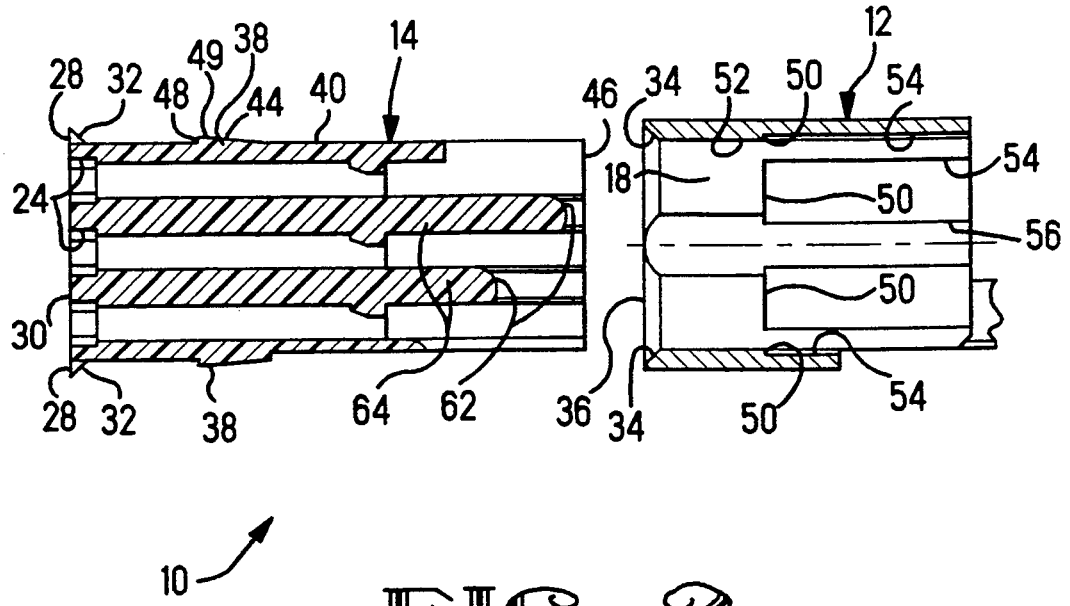
FIG. 2 is a longitudinal section view of one of the inserts positioned to be inserted into the shell member, and illustrating the latching arrangement of the present invention.

In FIGS. 1 and 2 the retention system of the present invention can be seen to include a peripheral lip 28 along the mating face 30 on the forward end of insert member 14, also duplicated on insert member 16. Lip 28 extends almost continuously about the periphery of mating face 30 which will be the trailing end of insert member 14 during insertion into shell member 12. Engagement or stop surface 32 is preferably tapered, corresponding to tapered inner corner 34 of leading edge 36 of shell member 12.

A plurality of latching projections 38 are formed on outer side surfaces 40 of insert member 14 regularly spaced therealong, and also on end surfaces 42. Each latching projection includes a slightly tapered bearing surface 44 extending from rearward end 46 of insert member 14 which will be the leading end during insertion into shell 12. Tapered bearing surface 44 concludes in forwardly facing latching ledge or stop surface 48 approximately midway between rearward and forward ends of insert member 14. It is preferred to provide a short axial surface portion 49 adjacent stop surface 48 at the end of tapered bearing surface 44 to reinforce the latching projection against being collapsed under excessive compression.

Corresponding with latching ledges 48 of latching projections 38, a plurality of stop surfaces 50 are formed along inside surfaces 52 of shell member 12 such as being machined thereon to face rearwardly. As rearward end 46 of insert member 14 is urged into cavity 18, bearing surfaces 44 of the plurality of latching projections engage and bear against inside surfaces 52 of shell member 12 and insert member 14 of resilient material is compressed at those locations. Upon full insertion, latching projections pass stop surfaces 50 and relax outwardly, and latching ledges 48 latch behind stop surfaces 50. Engagement surface 32 of peripheral lip 28 abuts tapered surface 34 of shell leading edge 36, defining a stop preventing further rearward movement, with latching ledges 32 positioned axially rearwardly of lip 28 in order to enter recesses 54 of shell inside surface 52 just as lip 28 engages leading edge 36. As seen in FIG. 2, the far inside end surface of shell member 12 includes a rounded recess 56 which is a channel for receipt of a rounded polarizing key (not shown) on the far end of insert member 14, which intersects recess 54 and stop surface 50 of the far end.

Figure 3:
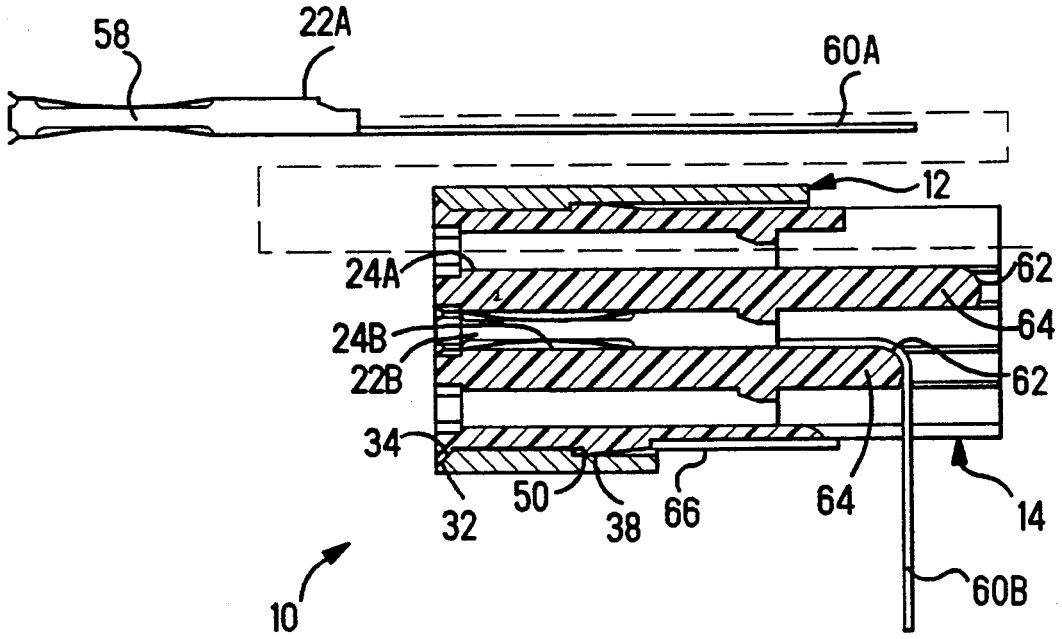
FIG. 3 is a view similar to FIG. 2 after assembly of the insert in the shell, showing a first contact being inserted into a passageway of the insert, and illustrating an inserted contact having a right angle formed in the tail contact section extending from the connector after insertion.

Referring to FIG. 3, insert member 14 has been inserted and latched within cavity 18 of shell member 12. The retention system will be resistant to axial stress upon mating and unmating with a mating connector 100 (FIG. 1) in both directions. A contact 22A is about to be inserted into passageway 24A, and includes a receptacle contact section 58 at its forward end, and an elongate tail 60A at its rearward end. Contact 22B is shown already inserted into respective passageway 24B, and elongate tail 60B has been formed downwardly over anvil 62 defined by a radiused or rounded corner of an extension 64 of insert member 14, thus extending at a right angle for insertion into a respective through-hole of a circuit board (not shown) coextending along a side 66 of connector 10, enabling right-angle board mounting.

Insert members 14, 16 can be molded of plastic resin, for example, liquid crystal polymer such as VECTRA A-130 (trademark of Hoechst-Celanese Corp.), which provides an appropriate level of resilience for the latching ledges to be only incremental in width. Shell member 12 can be machined, or cast or impact extruded and secondarily machined, of aluminum. Shell member 12 can also be molded of plastic, where it is desired for a common shell to be used with a variety of possible inserts having different styles or positions of contacts therein, for modularity.

Where shell member 12 is elongate and the side walls thereof are relatively thin, strengthening can be provided by rib sections extending across the rearward end of the shell to prevent the walls from being urged apart during insert insertion, with rib sections being received into corresponding slots across the rearward end of a single elongate insert between contact locations, if desired, or several smaller insert modules. However, providing latching at opposed ends of the insert member and the shell member is believed to be sufficient for insert retention.

Other modifications and variations may be made in the specific example disclosed herein without departing from the spirit of the invention nor the scope of the claims.

What is claimed is:

1. An electrical connector assembly, comprising:

a shell member and a dielectric insert member at least including passageways extending axially between first and second end faces for receipt of contacts thereinto, said insert member including outwardly facing surfaces extending axially between said first and second end faces, and said shell member including inside surfaces extending axially between leading and trailing ends and defining a cavity therewithin, said inside shell surfaces opposing and closely adjacent said outwardly facing insert surfaces upon assembly, said insert first end face insertable into said leading end of said shell member to be disposed within said cavity of said shell member, said insert member being molded of plastic material having only limited compressibility, and said insert member being retained in said shell member by first retention means comprising an array of latching projections integrally molded therewith and extending laterally outwardly from said outwardly facing surfaces of said insert member and spaced about the periphery of said insert member, each said latching projection being integrally supported along the length thereof by material of said insert member against laterally inward deflection and including a latching ledge facing said second end face, and cooperating latching means of said shell member comprising a corresponding array of stop surfaces along said inside surfaces of said shell member facing said trailing end of said shell member and being latchingly engageable by said latching ledges of said insert member upon full insertion of said insert member into said shell member, and second retention means comprising a lip extending laterally outwardly from the periphery of said second end face of said insert member and generally continuously therearound and engageable with said leading edge of said shell member upon full insert insertion.

2. An electrical connector assembly as set for in claim 1 wherein said latching ledges are disposed in a coplanar array about midway between said first and second insert end faces, and said corresponding stop surfaces of said shell member are located to correspond with the locations of said latching ledges.

3. An electrical connector assembly as set forth in claim 1 wherein ones of said latching projections are disposed on end ones of said outwardly facing surfaces of said insert member, and ones of said stop surfaces are defined on end ones of said inside surfaces of said shell member.

4. An electrical connector assembly as set forth in claim 1 wherein ones of said latching projections are disposed on side ones of said outwardly facing surfaces of said insert member, and ones of said stop surfaces are defined on side ones of said inside surfaces of said shell member.

5. An electrical connector assembly as set forth in claim 4 wherein ones of said latching projections are disposed on end ones of said outwardly facing surfaces of said insert member, and ones of said stop surfaces are defined on end ones of said inside surfaces of said shell member.

6. An electrical connector assembly as set forth in claim 1 wherein each said latching projection includes a tapered bearing surface extending toward said first end face to facilitate insertion of said insert member into said leading end of shell member.

7. An electrical connector assembly as set forth in claim 6 wherein each latching ledge has only an incremental transverse outward dimension, and said latching projection is elongate axially and includes a short axial surface portion concluding said tapered bearing surface at said latching ledge whereby said latching projection is strengthened against collapse under compression at said latching ledge.

8. An electrical connector assembly as set forth in claim 1 wherein said lip around said periphery of said second end face of said insert member is discontinuous at peripheral locations corresponding to peripheral locations of said latching projections, thereby facilitating molding of said insert member.

9. An assembly, comprising:

shell member and a insert member, said insert member including outwardly facing side surfaces extending axially between first and second end faces and said shell member including inside surfaces extending axially between leading and trailing ends and defining a cavity therewithin, said inside shell surfaces opposing and adjacent said outwardly facing insert side surfaces upon assembly, said insert first end face insertable into said leading end of said shell member to be disposed within said cavity of said shell member, said insert member being molded of plastic material having only limited compressibility, and said insert member being retained in said shell member by first retention means comprising an array of latching projections integrally molded therewith and extending laterally outwardly from said outwardly facing said surfaces of said insert member and spaced about the periphery of said insert member, each said latching projection being integrally supported along the length thereof by material of said insert member against laterally inward deflection and including a latching ledge facing said second end face, and cooperating latching means of said shell member comprising a corresponding array of stop surfaces along said inside surfaces of said shell member facing said trailing end of said shell member and being latchingly engageable by said latching ledges of said insert member upon full insertion of said insert member into said shell member, and second retention means comprising a lip extending laterally outwardly from the periphery of said second end face of said insert member and generally continuously therearound and engageable with said leading edge of said shell member upon full insert insertion.

* * * * *